US006105402A

United States Patent [19]

Lee

[11] Patent Number: 6,105,402

[45] Date of Patent: Aug. 22, 2000

[54] DESIGN OF SINKER AND SINKER CAM SHAPE FOR A CIRCULAR KNITTING MACHINE AND METHOD FOR PATTERNING FABRIC WITH THE COMBINATION OF AN ACTUATOR AND THESE NEWLY DESIGNED TOOLS

[76] Inventor: Kyung-Mok Lee, 666-1 3-GA, Nowon-dong, Buk-ku, Taegu, Rep. of Korea

[21] Appl. No.: 09/071,033

[22] Filed: May 4, 1998

Related U.S. Application Data

[63] Continuation-in-part of application No. 08/736,545, Oct. 24, 1996, abandoned.

[30] Foreign Application Priority Data

Oct. 24, 1995 [KR] Rep. of Korea ..... 95-36691

[51] Int. Cl.[7] ..... D04B 9/26

[52] U.S. Cl. ..... 66/217; 66/227

[58] Field of Search ..... 66/217, 219, 220, 66/221, 218, 222, 224, 225, 227

[56] References Cited

U.S. PATENT DOCUMENTS

| | | |
|---|---|---|
| 1,925,932 | 9/1933 | Page et al. . |
| 2,116,358 | 5/1938 | Leedham et al. . |
| 2,626,513 | 1/1953 | Lombardi . |
| 4,292,820 | 10/1981 | Ragoza et al. . |
| 4,519,221 | 5/1985 | Hirano . |
| 4,571,955 | 2/1986 | Stoppazzini . |
| 5,243,839 | 9/1993 | Digiuseppe et al. . |
| 5,511,393 | 4/1996 | Hu . |

*Primary Examiner*—Amy B. Vanatta
*Assistant Examiner*—Larry Worrell, Jr.
*Attorney, Agent, or Firm*—Robert E. Bushnell, Esq.

[57] ABSTRACT

A knitting machine has multiple stage sinkers which have multiple stages of butts in the rear part. A cam track fashions complicated patterns using the multiple stage sinkers. A mechanical or electronic device is installed to a top plate on an upper portion of a circular knitting machine. This device controls the sinkers.

20 Claims, 8 Drawing Sheets

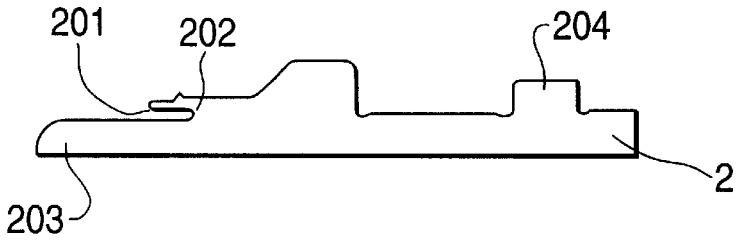
FIG. 2
FIG. 3A
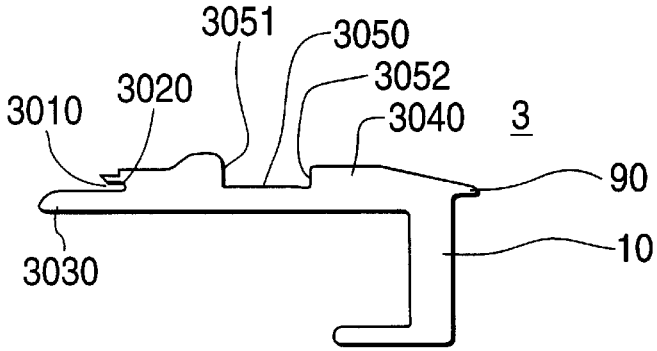
FIG. 3B
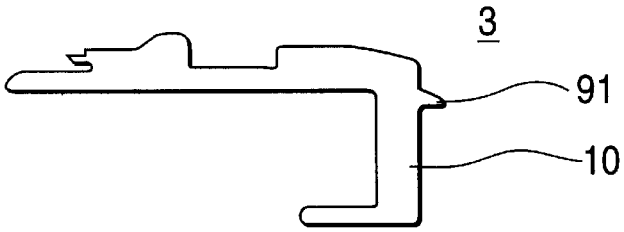
FIG. 3C
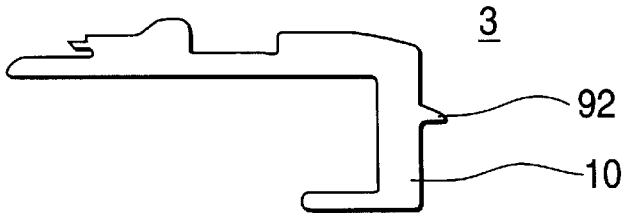
FIG. 3D
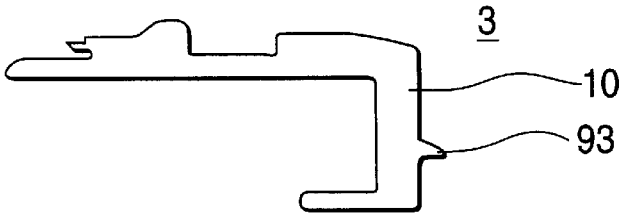

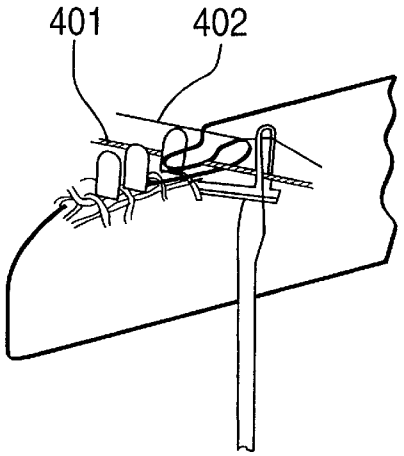
FIG. 10
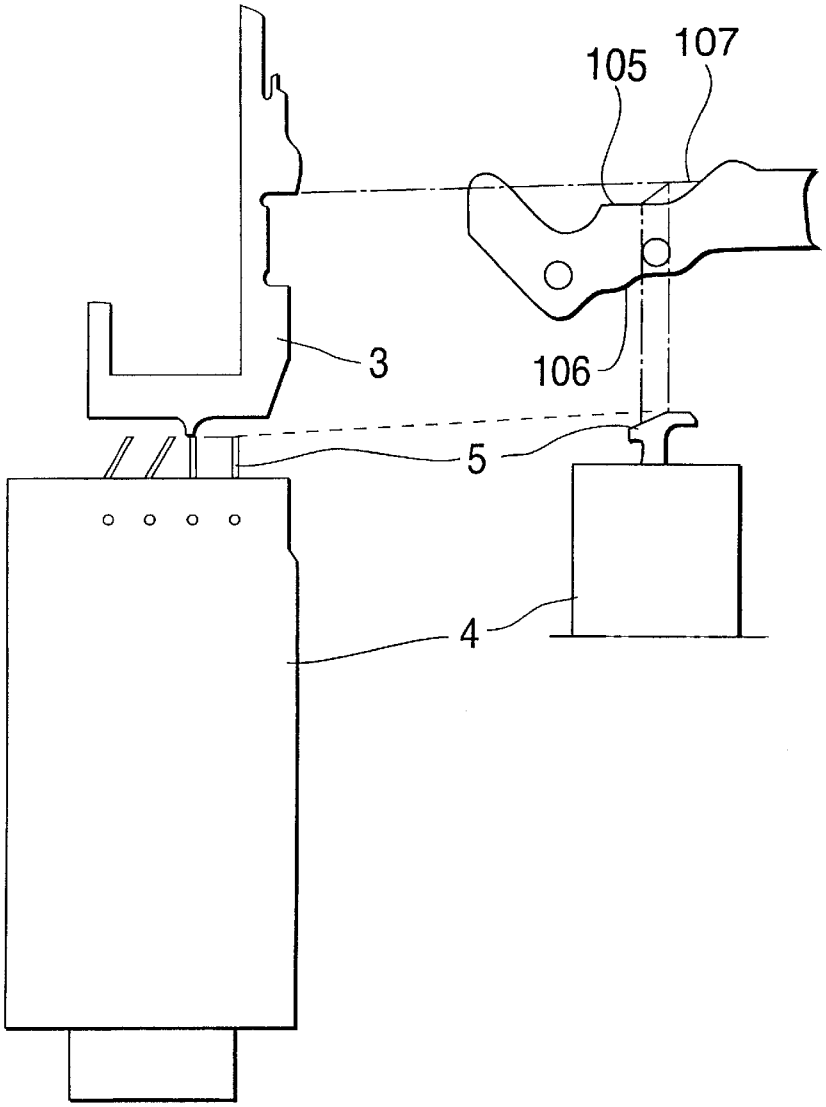

DESIGN OF SINKER AND SINKER CAM SHAPE FOR A CIRCULAR KNITTING MACHINE AND METHOD FOR PATTERNING FABRIC WITH THE COMBINATION OF AN ACTUATOR AND THESE NEWLY DESIGNED TOOLS

CROSS-REFERENCE TO RELATED APPLICATIONS

This application is a continuation-in-part of application Ser. No. 08/736,545, filed in the U.S. Patent & Trademark Office on the 24$^{th}$ of October 1996 now abandoned.

CLAIM OF PRIORITY

This application makes reference to, incorporates the same herein, and claims all benefits accruing under 35 U.S.C. §119 and 35 U.S.C. §120 from an application for DESIGN OF SINKER AND SINKER CAM SHAPE FOR A CIRCULAR KNITTING MACHINE AND METHOD FOR PATTERNING FABRIC WITH THE COMBINATION OF AN ACTUATOR AND THESE NEWLY DESIGNED TOOLS earlier filed in the Korean Industrial Property Office on the 24$^{th}$ of Oct. 1995 and there duly assigned Ser. No. 36691/1995.

BACKGROUND OF THE INVENTION

1. Field of Invention

This invention relates to a circular knitting machine using sinkers and sinker cams, and a method for making patterned fabric by using a combination of sinkers and an actuator.

2. Description of the Related Art

A knitting machine can use a sinker, a transporting mechanism for transporting the sinker, and a sinker cam for making knitted fabric that can be a component of a garment. In addition, the related arts use methods of making various patterns on a cloth. Exemplars of the related arts include Hu (U.S. Pat. No. 5,511,393, Sinker System for Knitting Face-Loop and Reverse-Loop Fabrics as well as Face-Loop Jacquard and Reverse-Loop Jacquard Fabrics, Apr. 30, 1996) teaching a use of a master sinker, a face-loop sinker, a reverse-loop sinker, and a jacquard sinker. Different fabrics can be obtained by matching different types of sinkers. Stoppazzini (U.S. Pat. No. 4,571,955, Automatic Straight Knitting Machine, Feb. 25, 1986) teaches a blade element which is placed under a needle of a knitting machine. The blade element has three butts, a first butt at the top, a second butt below, and a third butt at the bottom. Ragoza et al. (U.S. Pat. No. 4,292,820, Method of and Apparatus for Knitting the Heel of a Hosiery Article, Oct. 6, 1981) discusses a circular knitting machine with a plurality of cams. From my study of these exemplars of the contemporary practice and of the prior art, I find that there is a need for an effective circular knitting machine that uses multiple stage sinkers per a type of sinker.

SUMMARY OF THE INVENTION

An object of the present invention is to provide an improved circular knitting machine using sinkers and sinker cams.

Another object of the present invention is to provide an improved method for making patterned fabric by using a combination of a sinker and an actuator.

Another object of the present invention is to provide an apparatus that enables novice workers to operate the circular knitting machine with a short period of training time and to make patterns of arbitrary size.

Another object of the present invention is forming the cam track in a wavy, or undulating, shape to fashion complicated patterns using multiple stage sinkers.

Still another object of the present invention is installing mechanical or electronic device to a top plate attached to an upper portion of a circular knitting machine to control the sinkers for fashioning patterns.

To achieve one or more of the objects, the present invention proposes to provide a plurality of multiple stage sinkers having incrementally different and distinct stage butts in the rear of the sinker pins.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 2 depicts a front view of a sinker of a contemporary practice;

FIG. 3A is a front view showing a first stage sinker constructed according to the principles of the present invention;

FIG. 3B is a front view showing a second stage sinker constructed according to the principles of the present invention;

FIG. 3C is a front view showing a third stage sinker constructed according to the principles of the present invention;

FIG. 3D is a front view showing a fourth stage sinker constructed according to the principles of the present invention;

FIGS. 8A–10 are views showing the relationship between the sinker and the sinker cam.

DETAILED DESCRIPTION OF PREFERRED EMBODIMENT

With reference to attached drawings the preferred embodiment of the present invention will be described. Typically, a sinker of a circular knitting machine includes a loop forming sinker, often a metal sheet between needles in an elastic knitting machine. The loop forming sinker is for guiding knitting yarn to a throat of the sinker. The loop forming sinker is also for moving back and forth, so as to take part in the knitting machine forming a fabric. A holding down sinker is used in a latch knitting machine to knit the fabric and to prevent wrinkles in the knitted fabric. A cam fixed to a cam holder moves a needle up and down. The needle is formed between the cam and the cam cylinder. The cam moves the sinker along a cam track by means of the sinker cam, the shape of the sinker, and the butt in the sinker. This movement of the cam forms patterns on a knitted fabric.

In a circular knitting machine using latch needles, a fashioning apparatus forms a normal loop, in case the needle has risen to a knit position. Otherwise, the fashioning apparatus does not form a normal loop and does not put knitting yarn on the surface of knitted fabric. The fashioning apparatus achieves a patterning effect, depending on a particular knitting position. The fashioning apparatus is frequently of either the multiple stage needle system, the Jacquard system, or the electronic system.

Figure 1A:
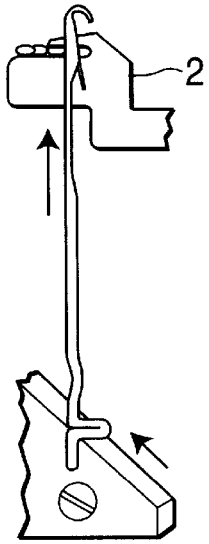
FIGS. 1A to 1E are a set of illustrations showing motions of a sinker, a needle, a butt, and a cam.
Figure 1B:
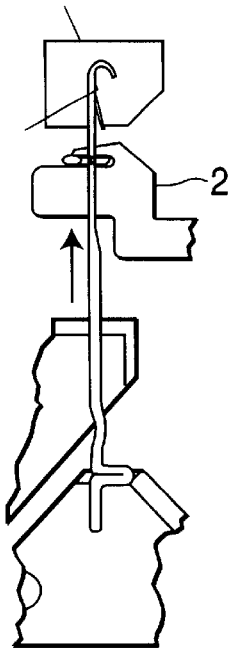
Figure 1C:
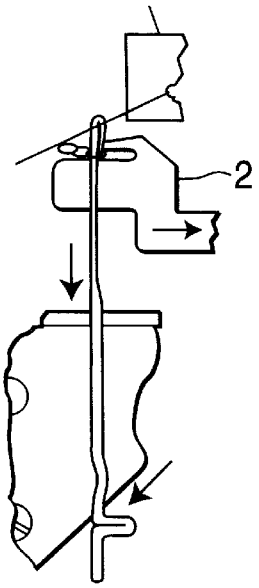
Figure 1D:
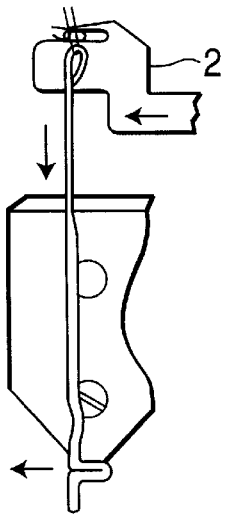
Figure 1E:
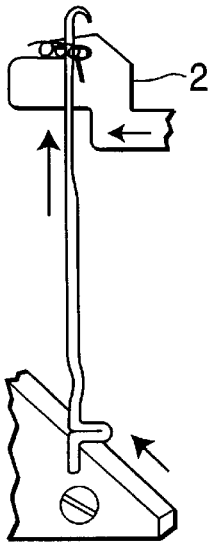

Turning now to the drawings, FIGS. 1A to 1E show respective knitting motion of a sinker, a needle, a butt, and a cam. Specifically, FIG. 1A shows the sinker supporting a loop at the forward position while the needle is rising. FIG. 1B and FIG. 1C show a sequence showing that once the needle receives a yarn, the sinker withdraws. FIG. 1D shows that, at the end (escape) of the loop, the sinker is at a backward position and prevents the excessive tension in the loop. FIG. 1E shows that, when the needle begins rising to form the next loop, the sinker moves forward. Then, the sinker pushes a needle backwards to prevent the needle from piercing the just completed new loop.

Figure 4:
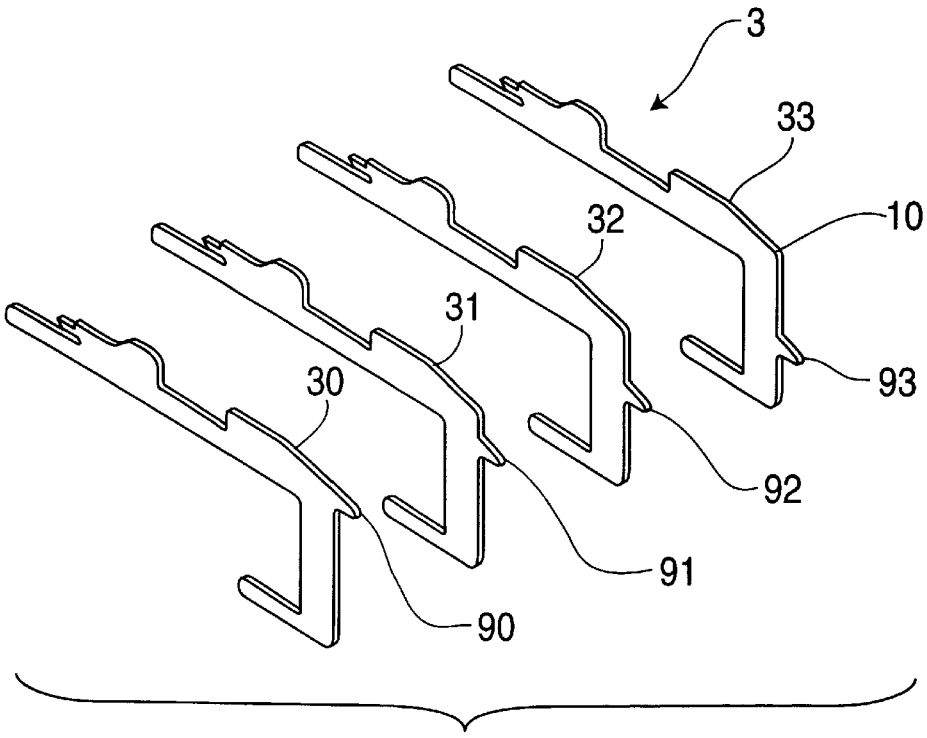
FIG. 4 depicts an exploded view showing the arrangement of sinkers according to the practice of the present invention.
Figure 5:
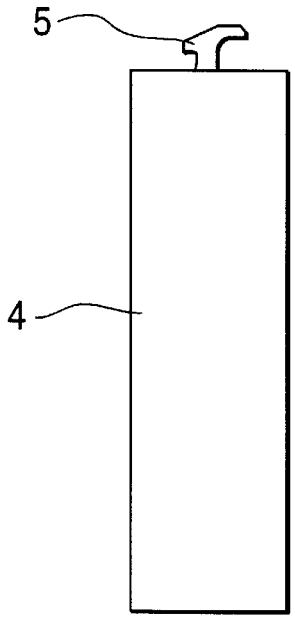
FIG. 5 depicts a top view of an actuator.

A circular knitting machine of the contemporary practice employs a sinker 2 for thin fabrics such as underwear, without a rear butt 9 (rear butts 90–93) such as the ones shown in FIG. 4. The sinker 2 has a throat 201, a nose 202, a flank 203, and a sinker top butt 204. Using the sinker 2, the circular knitting machine can make simple patterns by using a pattern wheel and an arrangement of needles. Due to a limited patterning range and a long fashioning time for knitted fabrics, a patterning using a sinker without a rear butt has low productivity. In addition, due to the high skill needed for fashioning with a circular knitting machine, novice workers can make only simple patterns. The cost increases because of employing high paying skilled workers and of training workers for a long period of time to operate a circular knitting machine. This is especially apparent in labor situations of high turnover due to such factors as migratory workers. Another problem is the substantially higher chance of accidents when an novice worker operates the machine.

Figure 6:
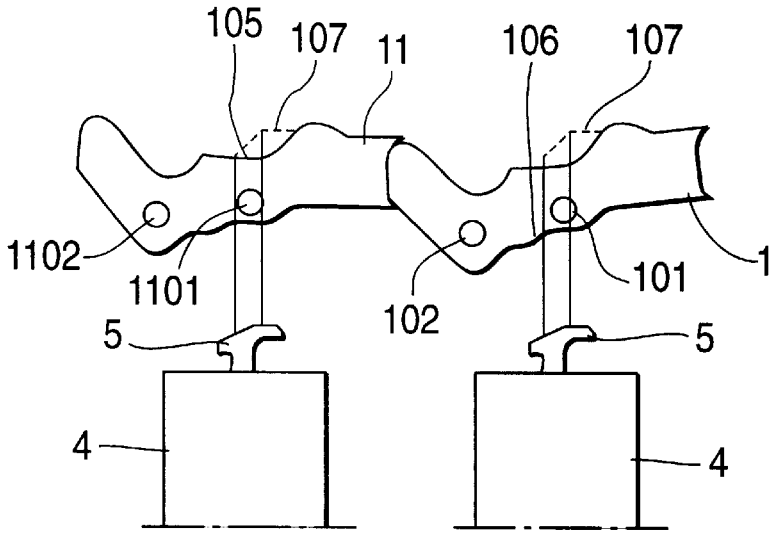
FIG. 6 depicts a top view of a cam track used in the practice of the present invention.

FIGS. 3A to 3E show sinkers of the present invention, the sinkers being made of multiple stages: FIG. 3A is a front view of a first sinker; FIG. 3B is a front view of a second sinker; FIG. 3C is a front view of a third sinker; and FIG. 3D is a front view of a fourth sinker. The sinkers use a cam as in FIG. 6. This FIG. 6 shows a top view of the cam. The cam operates with a set of sinkers consisting of four sinkers 3 (sinkers 30, 31, 32, and 33). The front and midsection of these sinkers are shaped generally as in the sinker 2 of the contemporary practice. A sinker 3 has a throat 3010, a nose 3020, a flank 3030, and a top butt 3040. The tail portion of these sinkers hook downward as shown in FIG. 3. In its rear each sinker has a rear butt 90, 91, 92, or 93 in four different positions respectively. The four sinkers 30, 31, 32, 33 correspond to four rear butts 90, 91, 92, and 93 at four different places respectively.

A first rear butt 90 for a first sinker 30 is formed at a place near the top of the sinker tail portion of the first sinker 30. A second rear butt 91 for a second sinker 31 is formed at a place lower than the place for the first rear butt 90. A third rear butt 92 for a third sinker 32 is formed at a place lower than the place where the second rear butt 91 is formed. Accordingly, a fourth rear butt 93 for a fourth sinker 33 is formed at a place lower than that of the third rear butt 92.

The sinkers 3 having shapes described above are arranged in the machine in the sequence of the first sinker 30, the second sinker 31, the third sinker 32, and the fourth sinker 33. The arrangement is according to the location of the rear butts. The sinkers 3 are assembled to a dial 8 by inserting rear butts. The rear butts are arranged in the rear part of sinker 3, the arrangement having the sequence of the first rear butt 90, the second rear butt 91, the third rear butt 92, and the fourth rear butt 93 in order to correspond to an actuator 4. In coordination with these sinkers, a plurality of sinker cams 1 of a wavy shape are catenated to form a continuous track 11. The sinker cam 1 has slots 101 and 102. The track 11 for the sinker cams 1 has slots 1101 and 1102.

Figure 7:
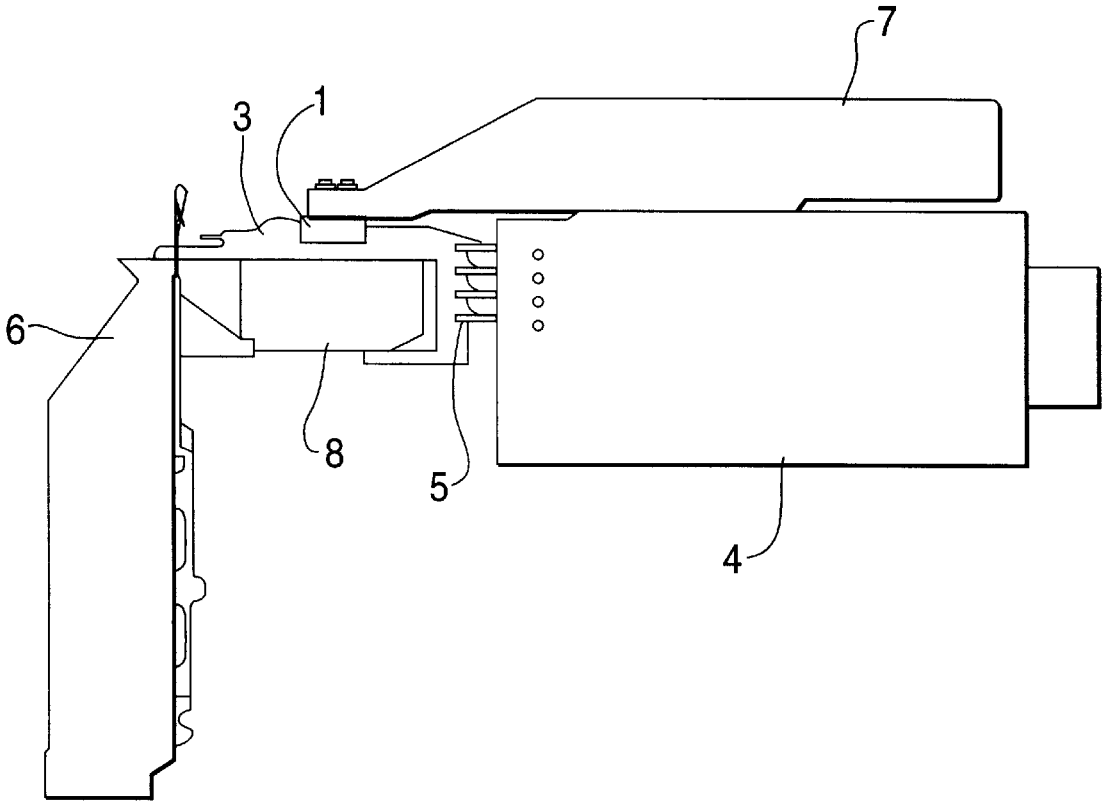
FIG. 7 depicts a view of an assembled machine when an actuator and a sinker are attached to a cylinder according to the principles of the present invention.

Usually, the actuator 4 has a magnet, a plurality of internal members inside, and actuator fingers 5 sticking out of the actuator. The members are powered by an electric or external power to move plates. The actuator 4 can therefore select a sinker 3 to be used for patterning. This is because the actuator fingers 5 moves as the plates do and the sinkers 3 are connected to the actuator fingers 5. The actuator fingers 5, installed to a lower part of a sinker cam ring 7, maintain a predetermined distance from the rear butts 9 of the sinker pins 3 installed to the dial, as it is depicted in FIG. 7, in order to fashion the patterns on knitted fabric.

The actuator 4, electromagnetically or by other means, selects one of the sinkers 3 out of the four sinkers. The selection is done according to their respective positions of rear butts 9. Subsequently, the selected sinker of the sinkers 3 moves to form a normal loop with a needle risen to a knit position. Meanwhile, the rest of the sinkers remain stationary. Knitting yarn of the selected sinker, corresponding to the normal loop, appears on the surface of knitted fabric. In contrast, the knitting yarn of the sinkers that were not selected do not appear on knitted fabric; the sinkers that were not selected do not form a normal loop. Therefore, the sections with the normal loop and without the loop appear on different places on knitted fabric to form patterns on knitted fabric. Such patterns can be stored in diskettes or memory chips so as to make the actuator fingers 5 move continuously according to the stored pattern. The actuator fingers 5 either selects or does not select a sinker among the sinkers 3. The resultant alternation of loops on a surface of knitted fabric forms a pattern.

The operation of the preferred embodiment of the present invention and its effect will be described below. Once the machine is powered on, the dial, attached to a cylinder 6 and the sinkers 3 installed in the slot of the dial, rotates as the cylinder 6 spins. Among a plurality of the multi-stage sinkers 30, 31, 32, and 33 which have the rear butts 9 formed at different positions in their rear body 10, the actuator selects one of these sinkers 3. The actuator 4 selects with the vertical movement of the actuator fingers 5 which stick out of the actuator 4. This is done according to a pattern stored in a diskette or a chip. The selected sinker 3 moves along the track on the cylinder cam to form a wave of patterns on thin knitted fabric such as that of underwear. Meanwhile the other sinkers do not move along the track. Therefore, by the method described above, continuous or repeating patterns can be formed.

One advantage of this embodiment of the present invention is the reduced production cost; with the present invention, even a novice workers can fashion patterns on knitted fabric. Another advantage is that various different patterns can be formed. Also, the installed sinkers can form many patterns in a short period of time. Although the foregoing description is presented with the details of a particular embodiment using four sinkers, it should be noted that the principles of the present invention are applicable to embodiments using three sinkers or to embodiments using more than four sinkers.

Each of the four sinkers is active with only one selected needle. The needles are combined with a cylinder within a circular knitting machine and rotated because the cylinder is continuously rotating. The needles are moving up and down following a cylinder cam race and the sinkers are rotated at the same time with the rotation of the cylinder since the sinker is installed radially with respect to the sinker dial fixed to the cylinder. A sinker and a needle rotate and co-act together by means of the sinker moving forward-and-rearward following a cylinder cam 1; therefore, a fabric is knitted.

Figure 8A:
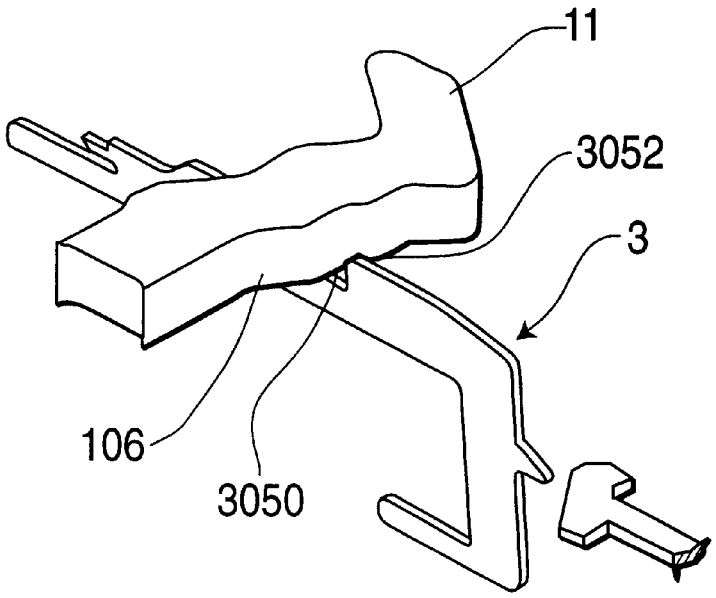
Figure 8B:
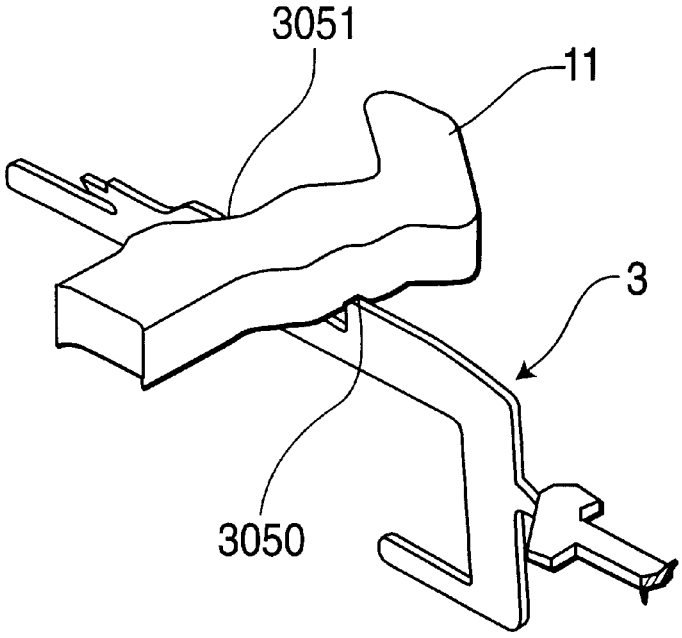
Figure 8C:
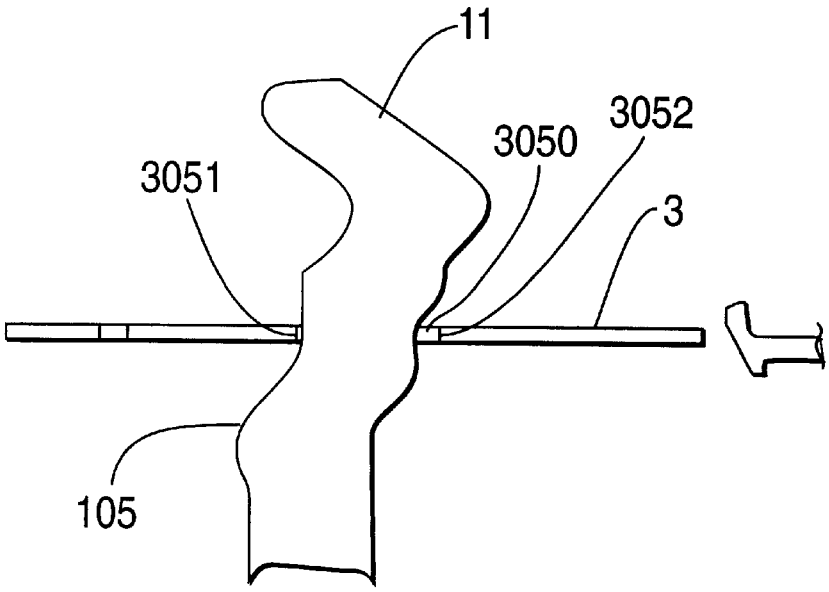
Figure 9:
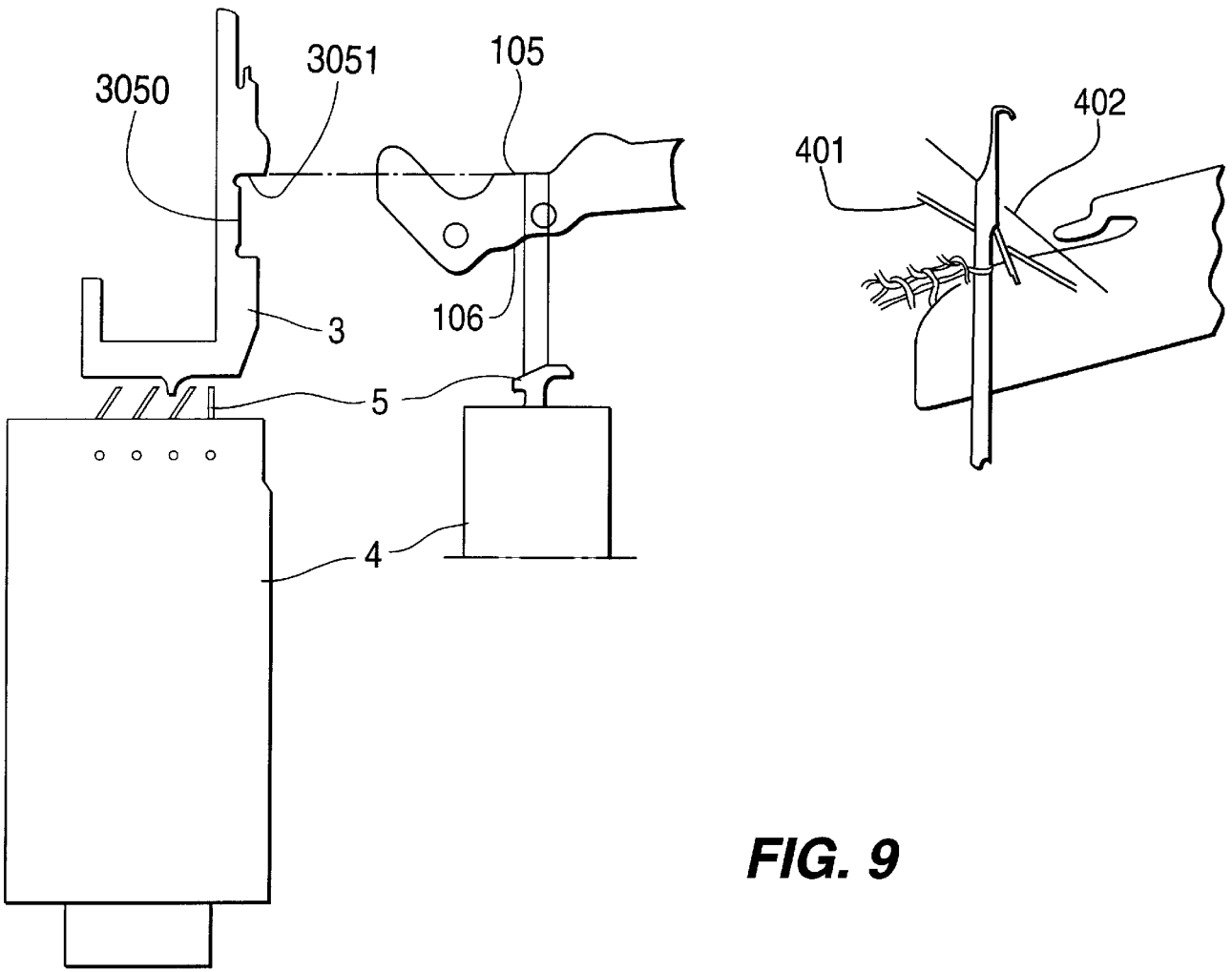

In the forward-and-rearward movement of the sinker, when an actuator finger 5 is separated from a rear butt 90, 91, 92, 93 of sinker (FIGS. 3A–3D), that is, in not in a selected state, the sinker continuously moves or rotates following the sinker cam 11 with a state of not being forwardly pushed, as shown in FIGS. 8A and 8C and 9. The upper side 105 of a sinker cam 11 contacts the upper side 3051 of the depression 3050 formed in the sinker 3 and moves or rotates. Accordingly, the needle catches the base yarn rather than the pile yarn, and therefore, a plain stitch is knitted.

Figure 8D:
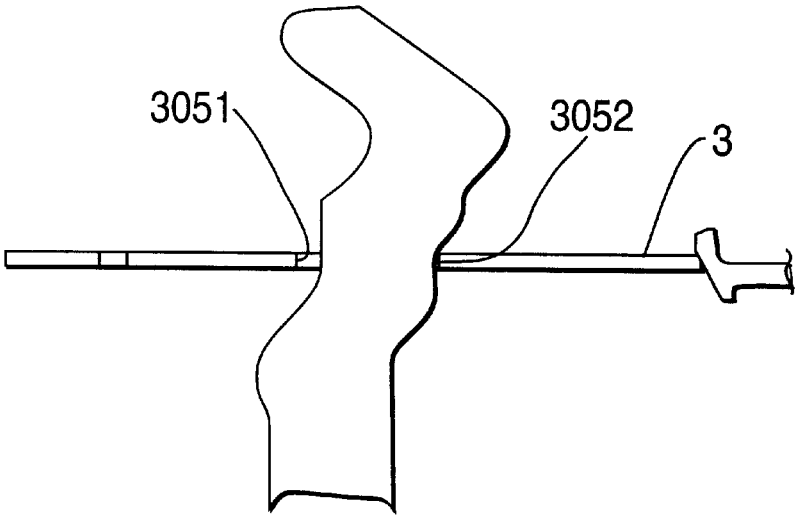

When a selected actuator finger 5 of the actuator 4 is operated by means of the signal stored in a computer and contacts a rear butt 90, 91, 92, 93 of a sinker (FIGS. 3A–3D), the actuator finger 5 forwardly moves the sinker. That is, when an actuator finger 5 contacts a rear butt 90, 91, 92, 93 of a sinker 30, as shown in FIGS. 8B, 8D and 10, the sinker and cam move together due to the contact of the down side 3052 of the depression 3050 formed in the sinker 3 and the down side 106 of the cam 11. In this condition, as shown in FIG. 10, the sinker moves in accordance with the part shown by the dotted line and a pile stitch is thereby knitted.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A circular knitting machine, comprising:

a plurality of needles disposed to receive yarn;

a first sinker disposed to interact with a first one said needles, said first sinker having a downwardly hooking rear body, with a first rear butt located at a first position on said rear body of said first sinker;

a second sinker disposed to interact with a second one of said needles, said second sinker having a downwardly hooking rear body, with a second rear butt located at a second position on said rear body of said second sinker different from said first position;

a third sinker disposed to interact with third one of said needles, said third sinker having a downwardly hooking rear body, with a third rear butt located at a third position on said rear body of said third sinker different from said second position;

a fourth sinker disposed to interact with said needle, said fourth sinker having a downward hooking rear body, with a fourth rear butt located at a fourth position of said rear body of said fourth sinker different from said third position;

a first cam disposed to permit movement of said needles along a first cam track formed on said first cam;

a second cam disposed to move said first, second, third, and fourth sinkers along a second cam track;

a dial disposed to hold said sinkers as said first, second, third, and fourth sinkers move along said second cam track; and an actuator having a first, a second, a third, and a fourth fingers, each disposed to select different corresponding ones of said sinkers.

2. The circular knitting machine according to claim 1, wherein:

said second position of said second rear butt is relatively lower than said first position of said first rear butt;

said third position of said third rear butt is relatively lower than said second position of said second rear butt; and said fourth position of said fourth rear butt is relatively lower than said third position of said third rear butt.

3. The circular knitting machine according to claim 2, wherein said first position of said first rear butt is near a beginning of said downward hooking rear body of said first sinker.

4. The circular knitting machine according to claim 3, wherein said second cam track has an undulating shape.

5. The circular knitting machine according to claim 1, wherein each rear butt of said rear bodies of said first, second, third, and fourth sinkers is selected by different corresponding ones of said first, second, third, and fourth fingers, respectively.

6. The circular knitting machine according to claim 5, wherein said sinkers are installed by inserting a first rear butt, a second rear butt, a third rear butt, and a fourth rear butt into a dial.

7. The circular knitting machine according to claim 5, wherein each said finger is matched to a corresponding rear butt of said sinkers.

8. The circular knitting machine according to claim 5, wherein said selected one of said sinkers forms a pile loop with said needle, and the other sinkers knit a plain knitted fabric.

9. The circular knitting machine according to claim 8, wherein said selected one of said sinkers forms patterns on a fabric.

10. The circular knitting machine according to claim 1, wherein said actuator operates by an electromagnetic means.

11. The circular knitting machine according to claim 1, wherein said each of said fingers moves each corresponding ones of said sinkers in accordance with an electronically stored pattern.

12. The circular knitting machine according to claim 1, wherein said first, second, third, and fourth sinkers each further comprise a substantially planar unitary structure having a central void defined by an elongated arm exhibiting a major length connected by a transverse member exhibiting a second length to a distal arm exhibiting a minor length and extending approximately parallel to but spaced apart by said central void and said second length from said elongated arm, said first, second, third, and fourth rear butts being positioned on and protruding from incrementally different positions along corresponding sides of said transverse members opposite from corresponding ones of said elongated arms, said distal arms and said voids.

13. A method of operating a circular knitting machine, comprising the steps of:

allowing a plurality of needles to move along a first track of a first cam;

installing first and second sinkers to a dial;

allowing said sinkers to move along a second track of a second cam;

matching a first finger to a rear butt of said first sinker and a second finger to a rear butt of said second sinker;

making a selection of one of first and second sinkers; and allowing said first sinker to move a predetermined distance during movement of said first sinker along said second track of said second cam on the basis of said selection while said second sinker moves along said second track of said second cam without allowing said second sinker to move said predetermined distance.

14. A circular knitting machine, comprising:

a first sinker disposed to interact with a first needle, said first sinker having a downwardly hooking rear body, with a first rear butt located at a first position of said rear body of said first sinker;

a second sinker disposed to interact with a second needle, said second sinker having a downwardly hooking rear body, with a second rear butt located at a second position of said rear body of said second sinker different from said first position;

a first cam disposed to permit movement of said needle along a first cam track formed on said first cam;

a second cam disposed to move said first and second sinkers along a second cam track formed on said second cam;

a dial disposed to hold said first and second sinkers as said and second sinkers move along said cam track; and an actuator having a first finger disposed to select said first sinker and second finger disposed to select said second sinker.

15. The circular knitting machine of claim 14, wherein said first and second sinkers each further comprise a substantially planar unitary structure having a central void defined by an elongated arm exhibiting a major length connected by a transverse member forming said rear butt and exhibiting a second length, to a distal arm exhibiting a minor length and extending approximately parallel to but spaced apart by said central void and said second length from said elongated arm, said first and second rear butts being positioned on and protruding from incrementally different positions along corresponding sides of said transverse members opposite from corresponding ones of said elongated arms, said distal arms and said voids.

16. The circular knitting machine according to claim 5, wherein said finger selects and moves the corresponding sinker by a predetermined distance during moving along said second cam track while the other sinkers move only along said second cam track without moving said predetermined distance.

17. The circular knitting machine according to claim 14, wherein said first finger selects said first sinker to be moved further by a predetermined distance during moving along said cam track while the other sinker moves only along said cam track without moving said predetermined distance.

18. The circular knitting machine according to claim 17, wherein said first sinker forms a pile loop with said first needle disposed to receive yarn while said second sinker forms a plain knit with said second needle disposed to receive yarn.

19. The method of claim 13, further comprised of the step of:

locating said first rear butt of said first sinker and said first finger on the same height as and on the different height from said second butt of said second sinker and said second finger.

20. The method of claim 13, further comprised of the step of:

allowing a first needle and said first sinker to form a pile loop while a second needle and said second sinker to form a plain knit.

* * * * *